United States Patent [19]

Pappas

[11] Patent Number: 4,580,769

[45] Date of Patent: Apr. 8, 1986

[54] CLAMP WITH MULTI-MODAL MOUNTING

[76] Inventor: Nick Pappas, 8369 Vickers St. Ste A, San Diego, Calif. 92111

[21] Appl. No.: 671,517

[22] Filed: Nov. 15, 1984

[51] Int. Cl.[4] ..... B25B 5/02

[52] U.S. Cl. ..... 269/88; 269/100; 269/166

[58] Field of Search ..... 269/88, 96, 166–171.5, 269/3–4, 249, 99, 100

[56] References Cited

U.S. PATENT DOCUMENTS

| | | | |
|---|---|---|---|
| 490,432 | 1/1893 | Gerhardt | 269/100 |
| 496,168 | 4/1893 | Port | 269/96 |
| 770,058 | 9/1904 | Foster | 269/99 X |
| 1,026,475 | 5/1912 | Tarbuck | 269/100 |
| 1,049,024 | 12/1912 | Woodstock | 269/99 |
| 1,890,042 | 12/1932 | Morandi | 269/166 X |
| 2,199,949 | 5/1940 | Davis | 269/166 X |
| 2,510,077 | 6/1950 | Coffman | 269/166 |
| 2,618,303 | 11/1952 | Ferguson et al. | 269/170 |
| 3,697,046 | 10/1972 | Sur | 269/249 X |
| 4,253,648 | 3/1981 | Meeks | 269/4 |
| 4,468,018 | 8/1984 | Vaizey | 269/166 X |
| 4,471,951 | 9/1984 | LeVine | 269/3 |

*Primary Examiner*—Frederick R. Schmidt
*Assistant Examiner*—Steven P. Schad
*Attorney, Agent, or Firm*—Ralph S. Branscomb

[57] ABSTRACT

A specialized clamp having a pair of spaced parallel jaw members that slide together on parallel rods orthogonally extended relative to the jaw members, there being a wall or surface mount which optionally engages and mounts the clamp either by a mounting end plate at the shank end of one of the jaws, or by sockets defined in the base into which the ends of the slide rods are inserted.

4 Claims, 7 Drawing Figures

2
54
42
44
48
49
44
38
54
2
32
30
18
32
12
16
10
52
28
26
28
34
22
18
34
22
30
14
16
20
36

40
44
48
49
44
54
54
38
46
50
40

40
40

38
42
5
32
12
10
5
52
26
24
22
14
20
56

38
42
12
54
32
28
30

7
32
12
52
7
26
24
26
34
14
20
54
42
54
38
49

52
30
28

CLAMP WITH MULTI-MODAL MOUNTING

BACKGROUND AND SUMMARY OF THE INVENTION

There are many types of clamps, pliers, wrenches and vices which have two jaws and are designed to bring the two jaws into clamping contact to one another. Typically, in a clamp for example, the concept is to enable the user to have considerable mechanical advantage, generally through use of a threaded shaft and a crank, to compress the jaws together with a great deal of force, perhaps several hundred pounds even with simple home shop clamps.

There is little available in the way of clipping and clamping devices which are operative at relatively low compression levels, and which are light weight and highly controllable. For example, the metal clamps used in woodworking and the like are not really suitable for holding a handle on a teacup while the glue dries. Not only because the jaws are generally metallic and would mar the teacup, but also because the screw-type compression generally is not highly controllable, and overtightening might easily result in breaking the handle in two before it was ever fixed in the first place.

Using this same teacup as an example, it would be nice to have a clamp that would operate under controllable, low pressure level and which was light enough that the teacup could be resting in its normal position without additional support and clamped in-place. Typically, clamps are so heavy that the teacup would roll around into an upended position.

There are such things are alligator clips and the like which will put a moderate degree of pressure on an object or objects. Clips are limited in that the maximum spacing between jaws at which the jaws are still reasonably parallel is very limited, because of the pivotal relationship between the jaws. Additionally, the force applied by the jaws of clips is not ordinarilly adjustable. What is needed is a small, very lightweight clamp with jaws which slip tight under finger pressure, maintaining the jaws parallel at all times, and permitting a wide opening to be established between the parallel jaws.

Such a need was met by the provision of the SLIP 'N GRIP clamp, which is the subject of co-pending design U.S. patent application No. 562,981, filed Dec. 19, 1983. This clamp has jaws that are made of lightweight plastic ribs sliding on small diameter aluminum rods, with cork tips, making it ideal for small repair jobs and for hobbyists. The jaws are squeezed together, and when they engage an object, the engagment spreads the jaws at a slightly non-parrallel orientation, wedging them on their rods. The pressure that is applied is thus easily controlled because it is not mechanically multiplied. The cork tips offer further yielding so that the clamp is ideal for small, delicate jobs, for example working with models, balsa wood, china or glass.

To further enhance the effectiveness of the SLIP 'N GRIP clamp, a multi-modal mounting structure has been devised which basically comprises a generally flat base defining a keyway thereon which cooperates with a key defined at the end of one of the clamp jaws to support the clamp in an orthogonal orientation to the surface on which the base is mounted.

In addition to the mounting orientation using the key and the key and the keyway, a pair of spaced sockets defined in the base can serve as an alternative clamp mounting means by virtue of the slide rods which mount the jaws, these rods being insertable into the rod sockets to mount the clamp at an angle orthogonal to the angle achieved by the first mounting technique.

DETAILED DESCRIPTION OF THE PREFERRED EMBODIMENT

Figure 1:
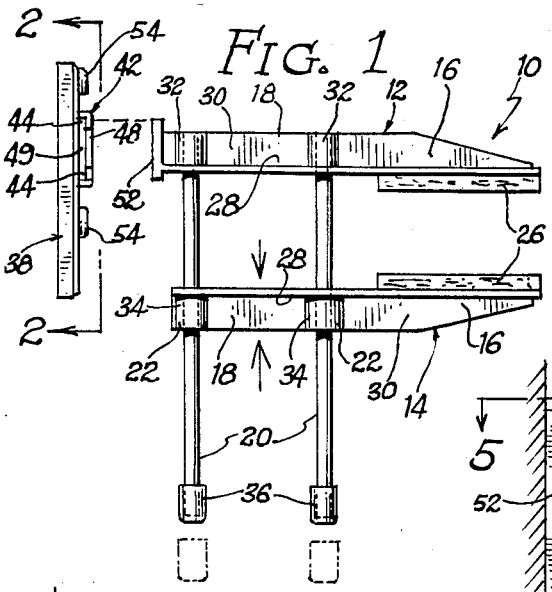
FIG. 1 is a side elevation showing the clamp exploded from the base.
Figure 2:
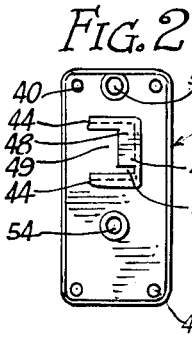
FIG. 2 is a front elevation view of the base.
Figure 3:
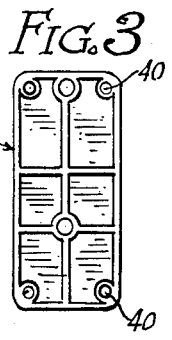
FIG. 3 is a rear elevation view of the base.

The clamp is shown at 10 and comprises first and second jaw members 12 and 14. These jaw members each have a jaw element 16 and a shank portion 18. A pair of slide rods 20 mount the first jaw member 12 fixedly in its shank portion, and pass through the rod channels 22 in the second jaw portion 14. The rod channels 22 are fairly precisely dimensioned to slide with little or no friction on the aluminum rods 20 but when the jaws compress an object such as that indicated at 24 in FIGS. 4 and 6, the jaws are skewered slightly out of parallelism and the jaws are held on the rods at the position to which they are squeezed. Opening the jaws is simply effected by popping the jaws apart again at their shank ends.

The jaw elements 16 are preferably each covered with a cork pad 26 for reasons of achieving both a frictional and a yielding gripping action. The rods 20 are shown as two in number, but could clearly be provided as more, and could even be provided as one. Each of the jaw members 12 and 14 is preferably constructed of a flat lip portion 28 and a reinforcing rib 30 running the length of the lip 28. In the first jaw member, bosses 32 tightly grip the ends of the rods and prevent their axial passage, whereas the bosses 34 in the second jaw member permit the sliding of the rods as described above. The lower ends of the rods as shown in FIG. 1 are each covered with a cap 36. The caps retain the jaw member 14 in place, and also prevent the bare metal tips of the rods from scratching finishes. The caps also serve a cosmetic function.

Figure 4:
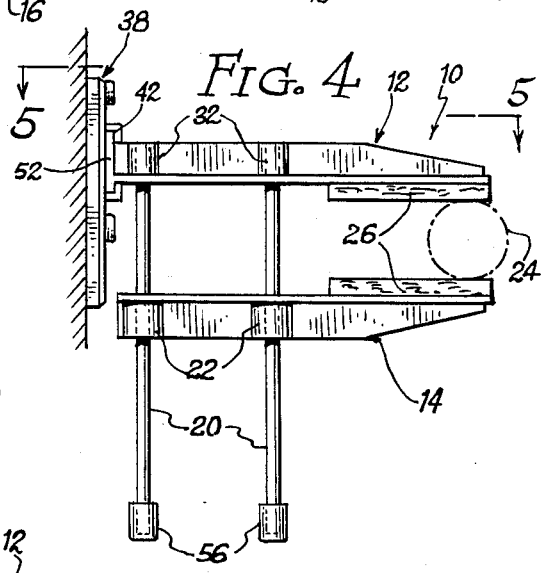
FIG. 4 is an elevation view similar to that of FIG. 1 but with the clamp in place in the base.
Figure 5:
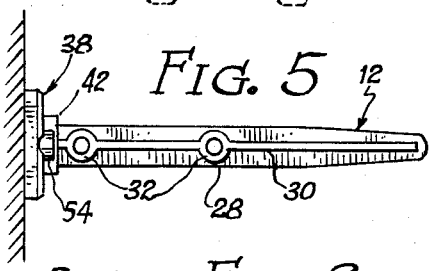
FIG. 5 is a plan view as seen from line 5—5 of FIG. 4.
Figure 7:
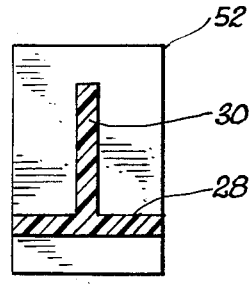

Turning now to the base member 38, this member is a generally planar rectangular piece with screw or nail holes 40 in the corners for mounting to any convenient flat surface. The front of the base defines a keyway 42 comprising integrally molded spaced parallel tracks 44, a stop wall 46 and a front panel 48 defining an internal socket 49. The front panel 48 has a slot 50 defined therein to accomodate the flat lip 28 at the base of the shank of the jaw member 12. A key, in the shape of a simple rectangle best seen in FIG. 7, slips easily but frictionally into the keyway 42 to mount as shown in FIGS. 4 and 5. It should be noted that the keyway overlaps the key on three edges, and defines positive support in all directions but the direction from which the key was slipped into the keyway. It thus provides for the mounting of the base on a wall in three different vertical or horizontal positions to achieve correspondingly different orientations of the clamp.

Figure 6:
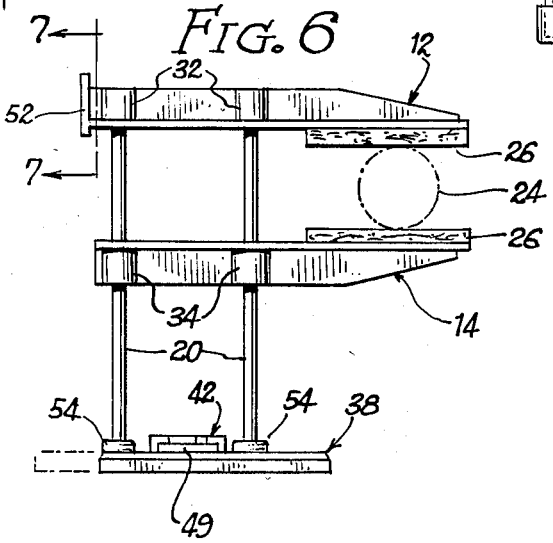
FIG. 6 is an elevation view similar to that shown in FIG. 4 but showing the rod mount versus the jaw mount arrangement; and, FIG. 7 is a section taken along line 7—7 of FIG. 6 illustrating the cross sectional nature of the jaw.

The base 38 also defines rod sockets 54, which are reinforced by being raised from the front surface of the base as shown in FIGS. 1, 4, 5 and 6. These sockets seat the tip ends 56 of the rods 20 after the caps 36 have been removed as shown in phantom in FIG. 1. In this orientation, two things occur that did not occur with the previously described mounting method. First, the jaws are now parallel to the working surface, such as a workbench, etc., whereas previously, with the key-and-keyway arrangement, they were orthogonal. Second, as can be seen in FIG. 6, the clamp is made more rigid by the fact that the two rods are maintained in spaced relation at a third point, the first two or course being the points at which the rods pass into the shanks of the jaw members.

Thus, the unit is mountable to either a horizontal or a vertical surface, and in either mounting position, will accomodate the jaws alternatively in a vertically extended or horizontally oriented configuration. As any hobbyist or putterer knows, this can be very important, as with the infinite variety of shapes and sizes of objects with which one putters, there is virtually no limit to the desirable flexibility of gripping and handling the vices.

In addition to this flexibility, unit is so lightweight and easy to use for small, low-pressure jobs that it fulfills a definite need in the marketplace. It does not compete directly with most handyman style clamps, vices, grip pliers and wrenches, but is in a league by itself. For the hobyist and householder, it fulfills a need hitherfore simply unfulfilled.

I claim:

1. A clamp with mounting comprising:

(a) a clamp comprising:

(i) a pair of jaw members having shank portions and jaw elements; and, (ii) at least two slide rods passing through said jaws members and being in sliding relationship with at least one of same, such that said jaw members can be slid together on said at least two slide rods causing said jaw elements to approach one another;

(b) a base adapted to be mounted on a flat surface and defining a keyway accessible when said base is mounted;

(c) one of said jaw members defining a key comprising a substantially planar plate, orthogonally extended relative to the jaw member defining same;

(d) said keyway defining a socket which laps around and grips said plate on three side edges thereof, said plate and socket being dimensioned such that said plate frictionally slides into, and is frictionally retained in said socket without further detent means; and, (e) a first of said jaw members fixedly mounting one end of each of said rods and the second of said jaw members sliding on said rods; and, (f) said base defining a rod socket for each of said rods, said rod sockets being spaced and positioned to seat all of said rods by the ends thereof on the side of said second jaw member remote from said first jaw member, such that said clamp can be alternatively mounted in said base either by said key or by said rods.

2. A clamp with mounting comprising:

(a) a clamp comprising:

(i) a pair of jaw members having shank portions and jaw elements; and, (ii) two slide rods passing through said jaw members and being in sliding relationship with at least one of same, such that said jaw members can be slid together on said two slide rods causing said jaw elements to approach one another;

(b) a base adapted to be mounted on a flat surface and defining a keyway accessible when said base is mounted;

(c) one of said jaw members defining a key comprising a substantially planar plate, orthogonally extended relative to the jaw member defining same and which fits into said keyway to rigidly mount said clamp in operative position on said base;

(d) said keyway defining a socket which laps around and grips said plate on three side edges thereof, said plate and socket being dimensioned such that said plate frictionally slides into, and is frictionally retained in said socket without further detent means;

(e) a first of said jaw members fixedly in mounting one end of each of said rods and the second of said jaw members sliding on said rods, and said base defining a rod socket for each of said rods, said rod sockets being spaced and positioned to seat all of said rods by the ends thereof on the side of said second jaw member remote from said first jaw member; and, (f) said base being generally planar and said rod sockets being defined in one side of said base and in spaced relation, with said keyway disposed therebetween so that said clamp can be alternatively mounted to said base either with said key in said keyway, or with said rods mounted in said rod sockets.

3. Structure according to claim 2 wherein said jaw members are generally perpendicular to said rods such that said clamp is mountable in two orthogonally oriented positions.

4. Structure according to claim 2 wherein said rods have caps, for retaining said second jaw member thereon, on each of the ends of said rods engaged by said sockets, said caps being removable to permit engagement of said rods in said rod sockets.

* * * * *